US005256344A

United States Patent [19]

Schimpf

[11] Patent Number: 5,256,344

[45] Date of Patent: Oct. 26, 1993

[54] PROCESS OF THERMALLY STABILIZING PAN FIBERS

[75] Inventor: Warren C. Schimpf, New Castle County, Del.

[73] Assignee: Hercules Incorporated, Wilmington, Del.

[21] Appl. No.: 908,720

[22] Filed: May 7, 1992

Related U.S. Application Data

[63] Continuation of Ser. No. 314,538, Feb. 23, 1989, abandoned.

[51] Int. Cl.[5] ..... D01F 9/22

[52] U.S. Cl. ..... 264/29.2; 264/29.6; 264/29.7; 264/83; 423/447.6; 423/447.7; 423/447.8

[58] Field of Search ..... 264/29.2, 29.6, 29.7, 83, 264/85;423/447.4, 447.6, 447.7, 447.8

[56] References Cited

U.S. PATENT DOCUMENTS 3,775,520 11/1973 Ram et al. ..... 423/447.7
3,862,334 1/1975 Turner ..... 423/447.6
3,961,888 6/1976 Riggs ..... 423/447.6 X

FOREIGN PATENT DOCUMENTS 0384299 2/1989 European Pat. Off. .

*Primary Examiner*—Leo B. Tentoni
*Attorney, Agent, or Firm*—Mark D. Kuller; Robert O'Flynn O'Brien

[57] ABSTRACT

PAN-based precursors are stabilized prior to carbonization in separate non-oxidizing and oxidizing environments according to process of the invention. Advantages of process include safer, more rapid stabilization and increase in the types of polymers which may be effectively stabilized.

17 Claims, 17 Drawing Sheets

PROCESS OF THERMALLY STABILIZING PAN FIBERS

This is a continuation of application Ser. No. 07/314,538, filed Feb. 23, 1989, now abandoned.

This invention relates to a novel method of manufacturing carbon fiber from a precursor comprising polyacrylonitrile polymer and, more particularly, to a novel approach in stabilizing the precursor prior to the carbonization that provides the carbon fiber.

Carbon fiber is a well known material useful in a variety of applications in view of its mechanical, chemical and electrical properties. Carbon fiber is particularly reknown for making lightweight composites comprising the fiber in inorganic or organic matrices.

The cost of carbon fiber has been decreasing significantly as compared to when it was first introduced several years ago while the properties and reliability also have been enhanced during this time. There still exists, however, long felt need for improvement in several aspects of carbon fiber manufacture. For example, the stabilization step, wherein polyacrylonitrile polymer in the form of a tow comprising a multitude of filaments is heated in air or other gaseous medium comprising oxygen prior to carbonization undesirably controls the rate at which carbon fiber is manufactured on a large scale.

Stabilization through oxidation is rate controlling because of the risk of fusing the filaments or even thermal runaway if the precursor is heated too fast or too high during the stabilization. The risk of thermal runaway is resultant of the use of certain monomers in making polyacrylonitrile polymer forming the filaments which, although permitting the oxidation reaction to commence at a lower temperature, also makes the fiber susceptible to thermal runaway. If such monomers are not used in making the polyacrylonitrile polymer precursor, then the precursor must be heated to still higher temperatures for initiation of the oxidation reaction which stabilizes the precursor and use of such higher temperatures runs even a higher risk of fusion of the filaments or thermal runaway.

Furthermore, as can be understood, reliability in manufacturing carbon fiber is currently and critically dependent upon careful manufacture of the precursor so it contains precise amounts of the monomer, e.g. acrylic acid, which enhances oxidation at lower temperatures. In addition, the oxidation reaction must be carefully controlled so the precursor is not heated too fast causing thermal runaway. Still further, the use of polyacrylonitrile homopolymer, more economical to make, has remained impractical to use as a precursor for carbon fiber.

Others have addressed pyrolysis or other heating of polyacrylonitrile precursor prior to carbonization. For example, U.S. Pat. No. 4,100,004 suggests dividing up the stabilization step so that the precursor is heated in separate temperature zones. Moreover, U.S. Pat. Nos. 3,775,520 and 3,954,950 suggest utilizing an initial brief heating step in an inert atmosphere prior to oxidizing the precursor. This initial heating step said to drive off residual solvent, is characterized by controlled shrinkage and may be undertaken in an inert atmosphere. These later patents, however, suggest limiting the initial brief heating step to prevent stabilization from occurring.

Failure of the prior art to mitigate problems associated with the rate controlling nature of the stabilization step is not because of lack of systematic study of the stabilization reaction. See, for example, "Studies on Carbonization of Polyacrylonitrile Fibre—Part 5: Changes in Structure with Pyrolysis of Polyacrylonitrile Fibre: by Miyamichi, et al., Journal of Society of Fibre Science and Technology, Japan, 22, No. 12, 538-547 (1966). Moreover, U.S. Pat. No. 2,445,042 has long ago suggested heating Polyacrylonitrile polymer in an inert medium although this patent suggests "air" is an "inert medium" and that discoloration be preferably prevented.

SUMMARY OF THE INVENTION

Now, in accordance with this invention, it has been discovered that stabilization of polyacrylonitrile polymer based precursor in making carbon fiber may be divided into separate reactions in a manner that eliminates the risk of thermal runaway otherwise existing when stabilization is made to occur in an oxygen containing environment. More particularly, the precursor is readily and safely stabilized in a form that is capable of being oxidized for subsequent carbonization. This form is achieved by heating the precursor in an atmosphere substantially free of oxygen in practice of this invention to form a thermally stabilized precursor followed by oxidation of the thermally stabilized precursor to provide a stabilized precursor that is oxidized for subsequent carbonization. Oxidation of the precursors according to this invention may be below temperatures ordinarily used for oxidation or alternatively may be at usual oxidation temperatures (e.g. between about 200° and 400° C.) or higher but at faster rates. Carbonization conditions after oxidation follow usual procedures practiced heretofore in making carbon fiber from polyacrylonitrile precursor.

DETAILED DESCRIPTION OF THE INVENTION

Figure 1:
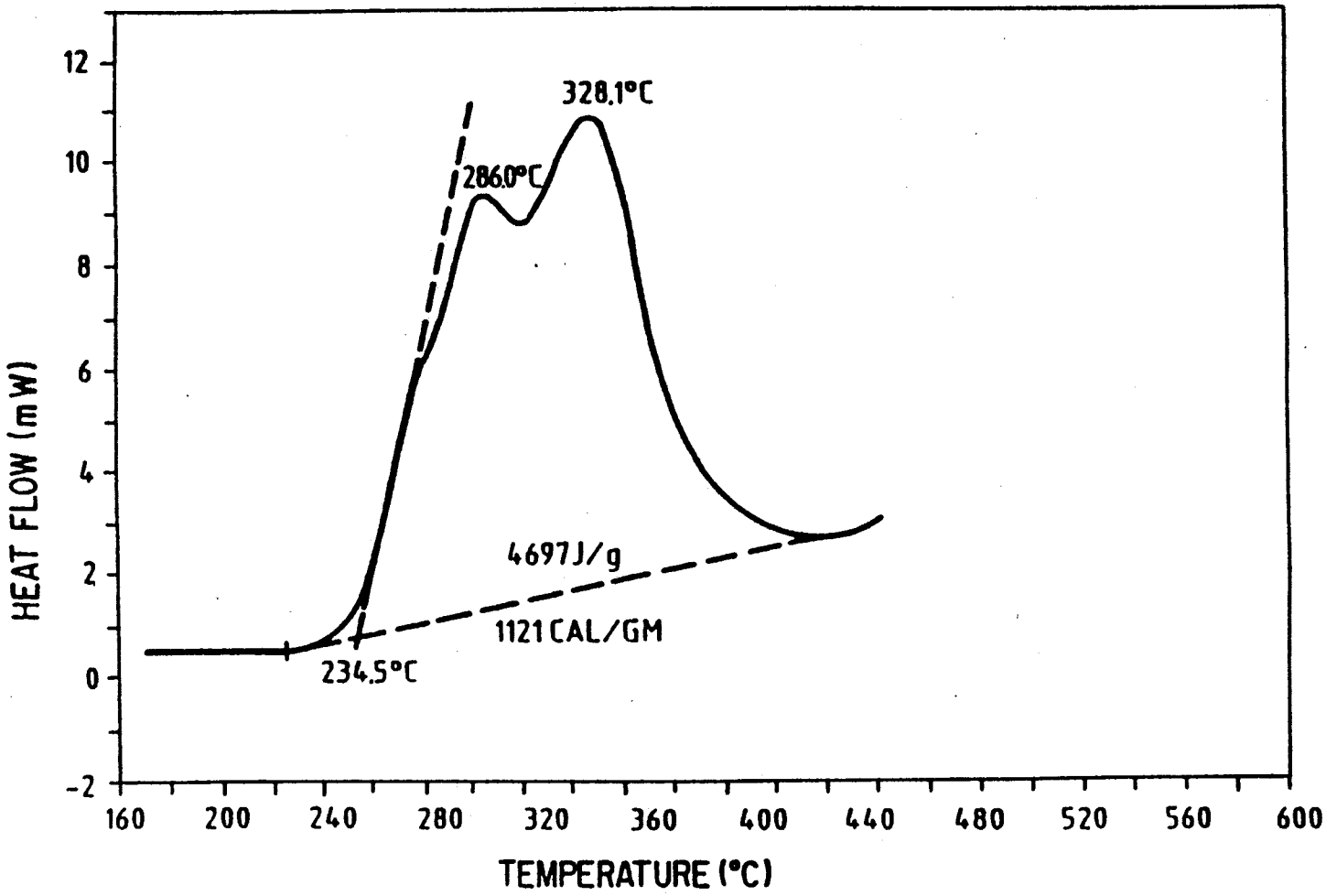
FIGS. 1-14 display graphically results of testing made according to the Examples.

Polyacrylonitrile polymers preferred as precursors for carbon fiber manufacture in accordance with this invention are well known materials. See, for example, U.S. Pat. Nos. 4,001,382, 4,009,248, 4,397,831 and 4,452,860, which are incorporated herein by reference for a description of the manufacture of such precursors. Quite advantageously, as will become more apparent, this invention widens the type of polyacrylonitrile polymers which are able to be used in making carbon fiber. For example, polyacrylonitrile homopolymer made from monomers which consist of acrylonitrile may be readily stabilized in accordance with this invention.

The precursor is heated in an atmosphere or environment free of oxygen in a first step in accordance with this invention. During the first step, the precursor becomes "thermally stabilized" according to this invention. Preferably, the environment consists essentially of nitrogen or other inert gas, although a vacuum may be also used. The temperature to which the precursor is heated ranges preferably ranges at least about 230° C. but, advantageously, may be up to 500° C. or higher without risk of thermal runaway.

Typically, one or more tows each comprising a multitude of continuous filaments traveling as a band are heated in a furnace or oven for stabilizing the precursor in accordance with this invention. This stabilization step ranges from minutes up to about an hour or more depending on the temperature chosen and may be conducted in a series of steps, if desired.

The amount of heating the precursor is chosen to receive in accordance with this invention may be predetermined by differential scanning calorimetry (DSC), a technique well known in the art, or other technique which measures thermal rearrangement. The difference in residual heat of reaction measured by DSC before and after heating without oxygen, is a measure of thermal rearrangement. Preferably, the residual heat of reaction by DSC in an inert atmosphere is reduced by at least about 10%, more preferably by about 20%, or even higher, e.g. about 35% or higher by heating in absence of air in accordance with this invention.

The diameter of filaments within the tow ranges between 1 and 10 microns, although the magnitude of such diameter is not critical in accordance with this invention. Moreover, each tow may comprise between 500 and 20,000 filaments per tow. The use of surface treatments on the filaments within the tow such as now practiced in the art does not distract from the benefits of this invention.

After being heated in absence of oxygen, the tows are preferably oxidized at temperatures ranging surprisingly as low as room temperature or even lower for a time to cause oxidation of the precursor tows that have been thermally stabilized. It is preferred that oxidation occurs in a gaseous medium such as air at temperatures ranging between 150° C. and 300° C. for a time sufficient to allow these thermally stabilized tows to be self supporting (i.e. retain integrity) during carbonization. Too high a temperature during oxidation is desirably avoided unless such heating is in means for carrying away thermal decomposition products of the fiber being oxidized.

In a preferred embodiment of the invention, wherein without the improvement of this invention, there is a plurality of said tows which travel together through an oven or ovens maintained at a temperature in a first range for forming said stabilized precursor that is oxidized, but wherein in accordance with the improvement of this invention, said plurality of tows travel together at a second, higher line speed than said first line speed as a band of closely spaced tows through a furnace which is substantially free of oxygen followed by travel at said higher line speed through said over or ovens, more preferably wherein said band travels through an oven or ovens maintained at a temperature below that temperature which would otherwise be optimal in providing a stabilized precursor that is oxidized.

The precursor undergoing heating in the non-oxidizing atmosphere may be stretched to a length longer than its original length before such heating, held constant in length or allowed to shrink as desired. Similarly, the precursor tows may be stretched, held constant or allowed to shrink during the oxidation reaction.

After oxidation, the thermally stabilized precursor tows that have been oxidized, as described above, are carbonized using standard techniques heretofore employed in making carbon fiber. For example, the stabilized and oxidized precursor tow is heated in an inert atmosphere or vacuum at a temperature between about 500° C. and 800° C. for tar removal followed by heating at higher temperatures, also in nitrogen or other non-oxidizing atmosphere, to yield a carbonized fiber suitable for use with or without surface treatment, as carbon fiber is now used in the art.

The following examples illustrate principles of this invention but are not intended as limiting the scope thereof. A brief description of the figures associated with these examples is set forth below.

FIGS. 1–14 graphically display results discussed in the Examples. The DSC apparatus used was a DuPont 910 DSC Module with a Model 1090 or like controller.

Figure 11:
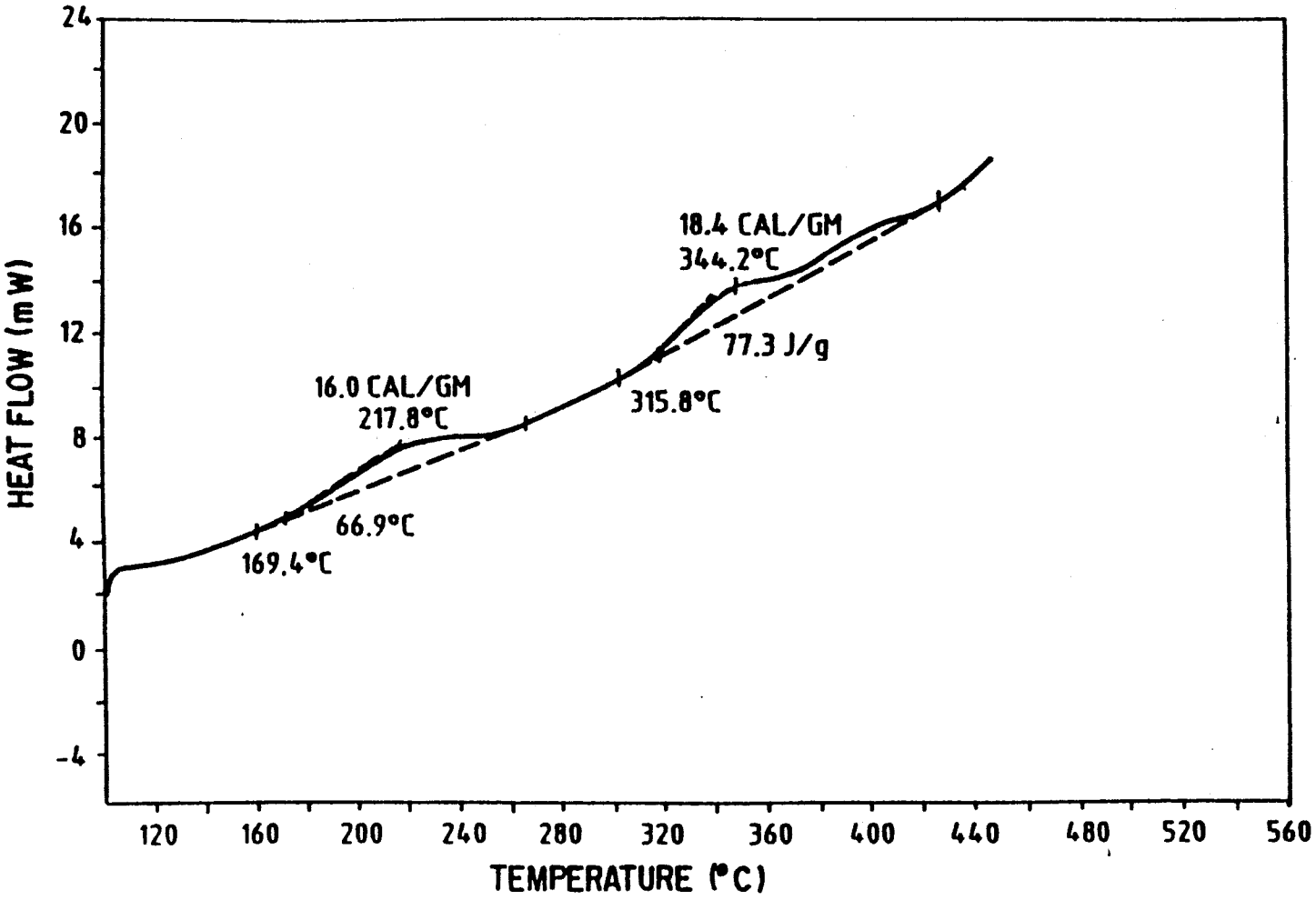
Figure 11A:
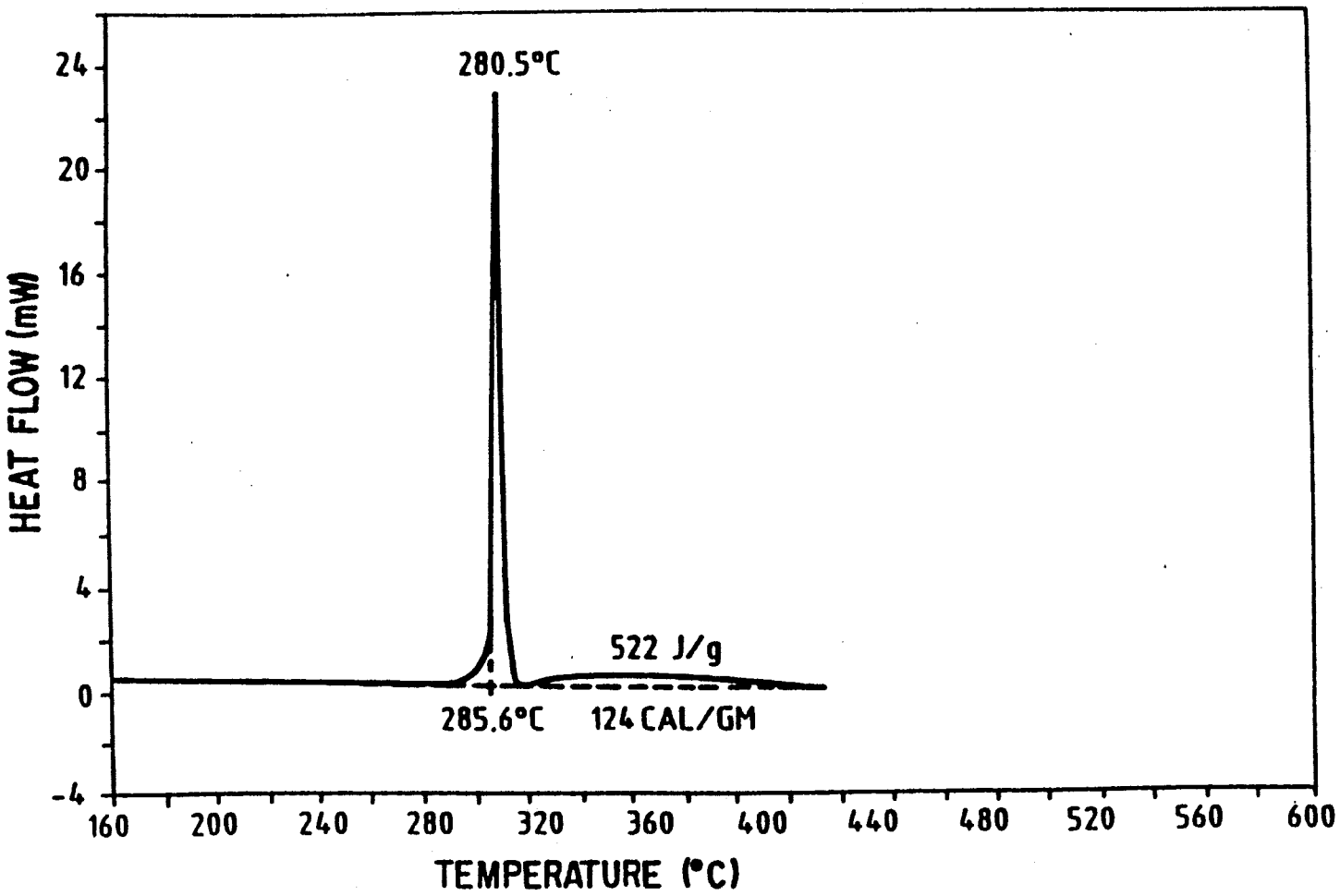
Figure 11B:
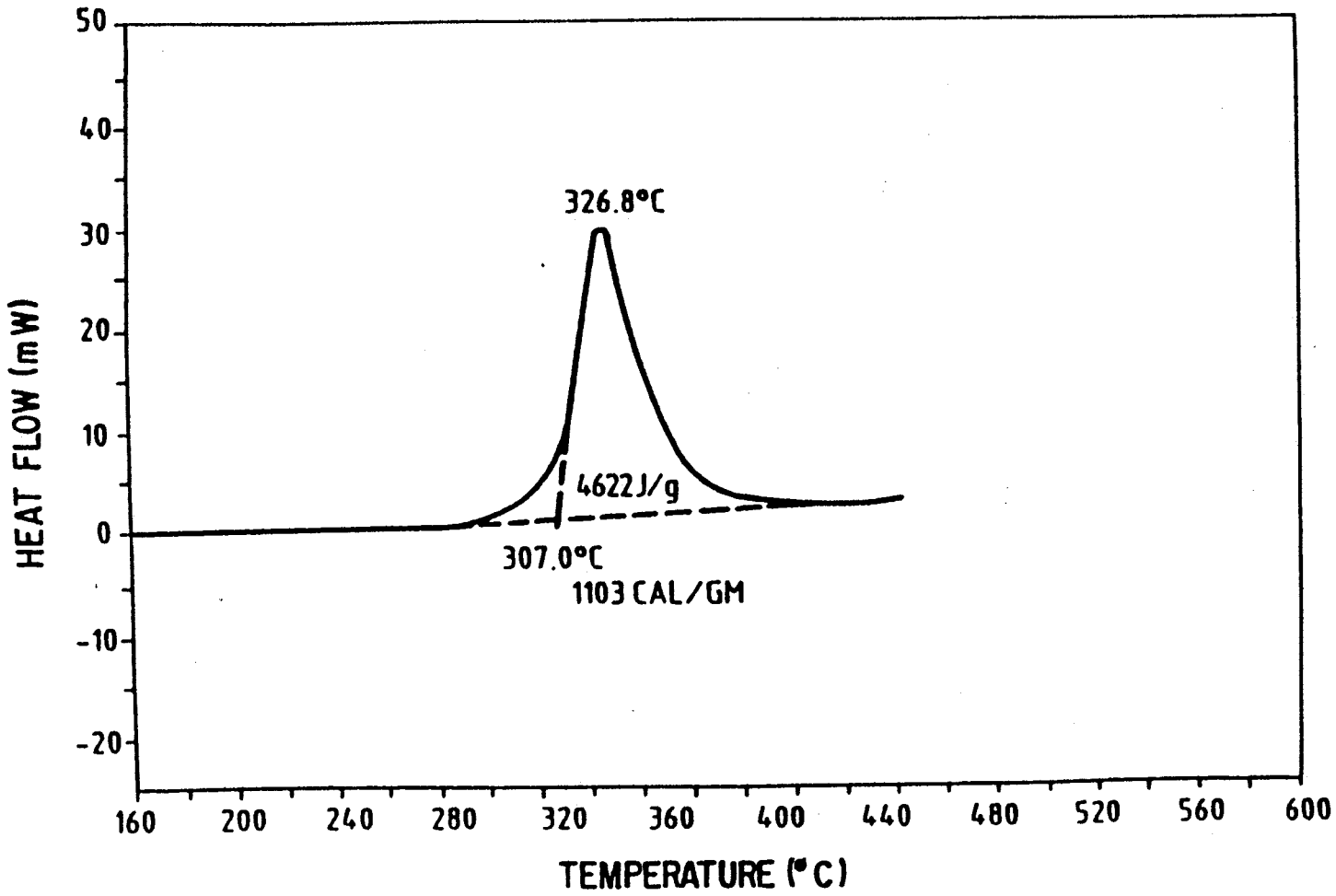
Figure 11C:
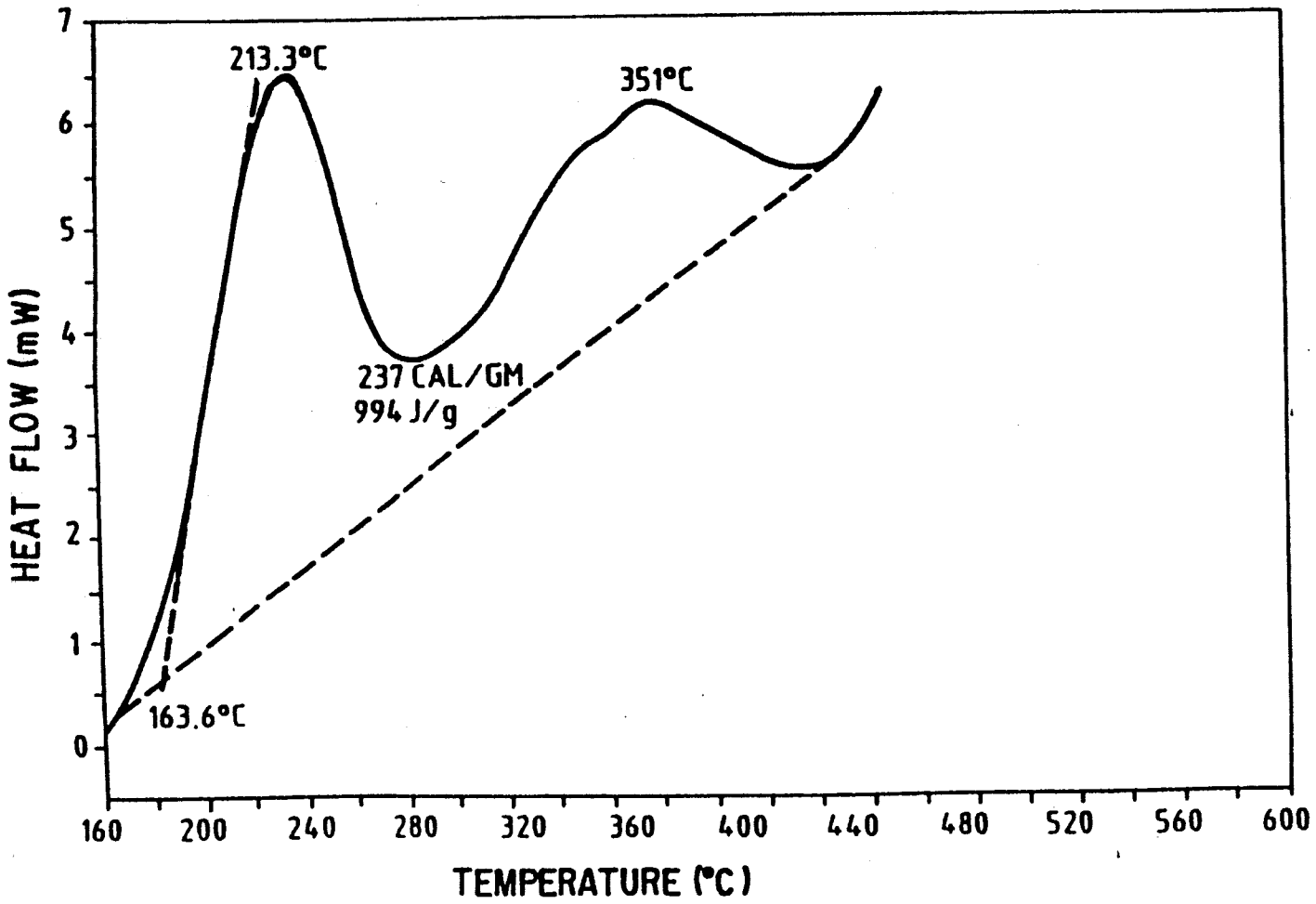
Figure 12:
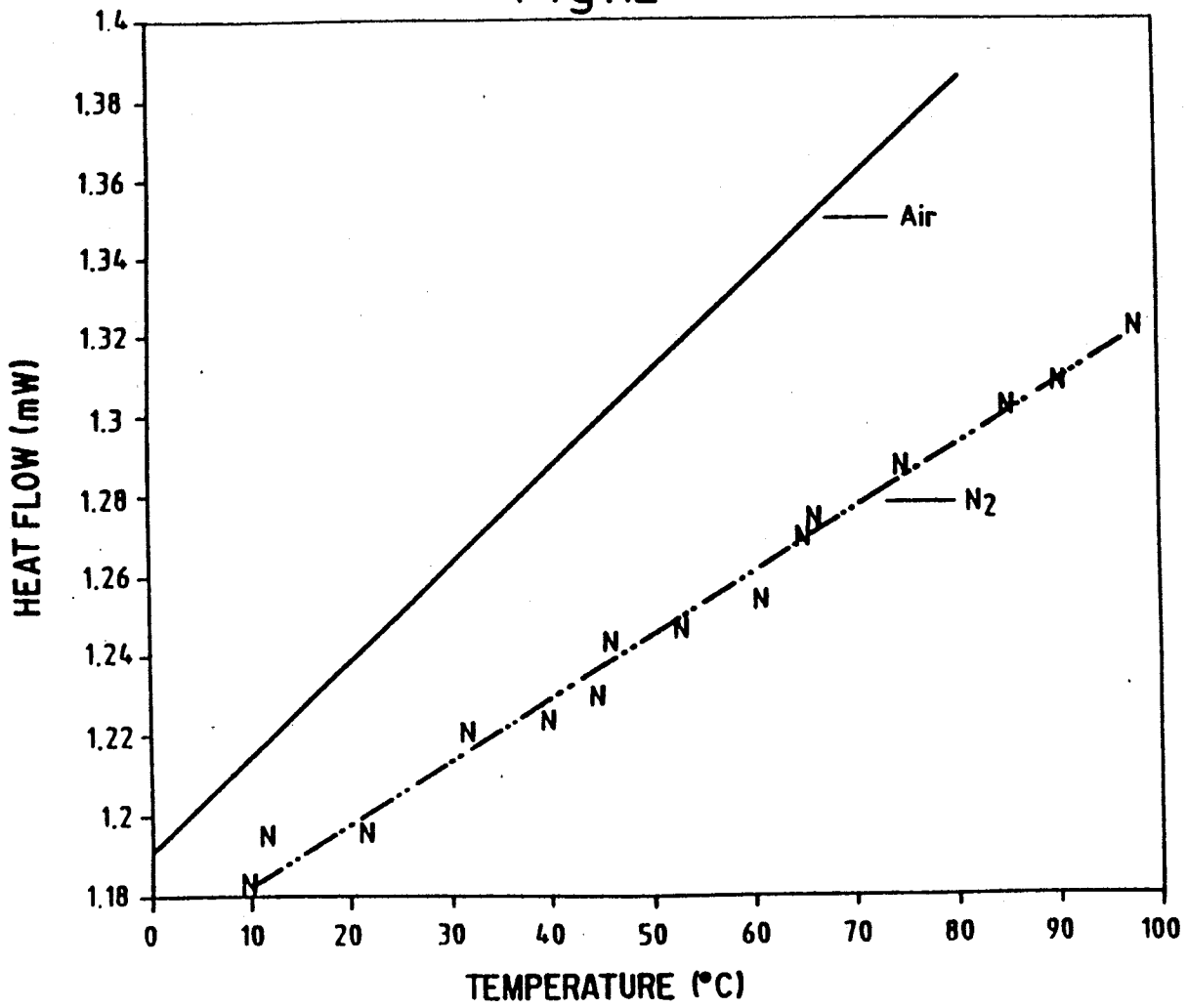
Figure 13:
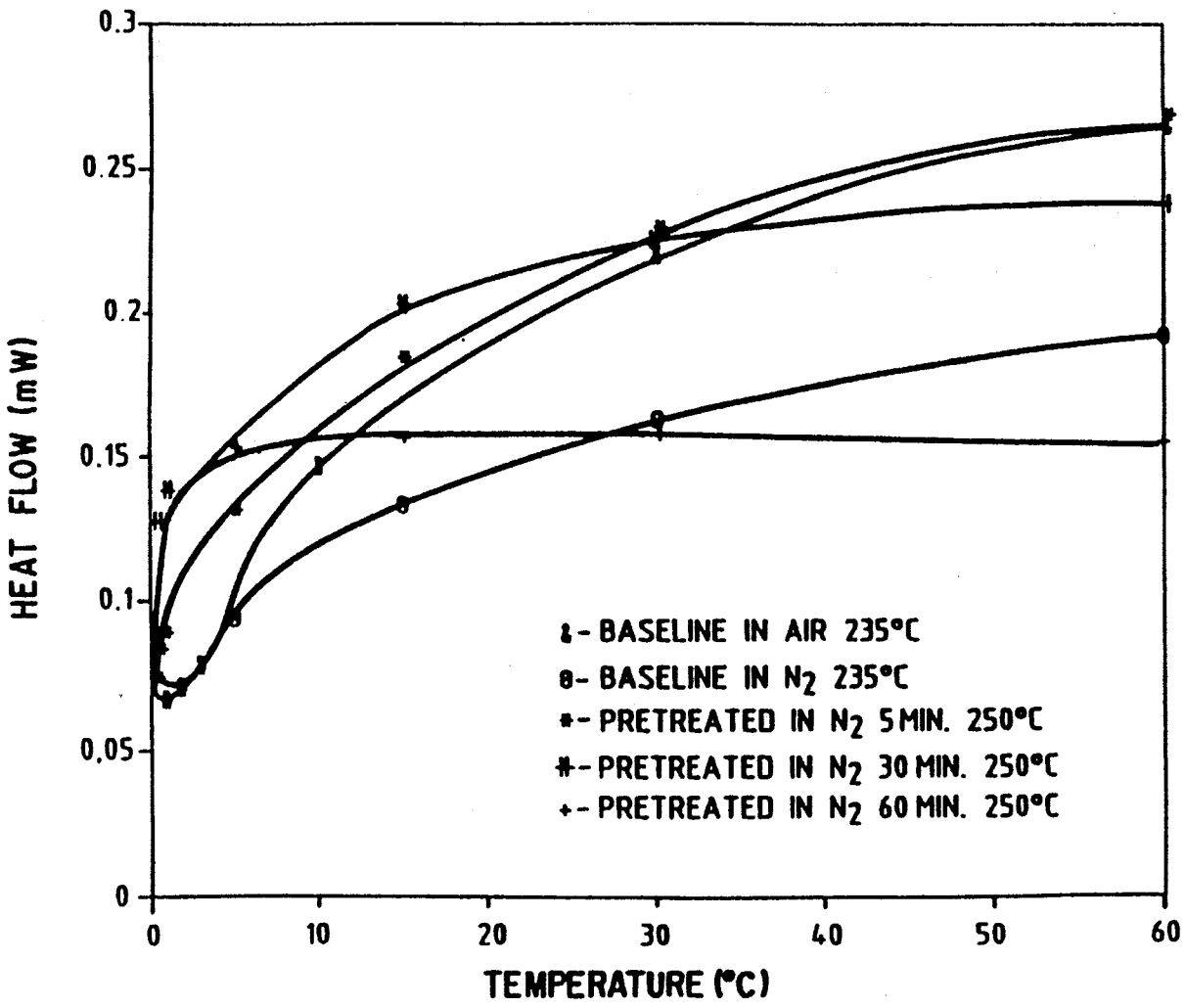
Figure 14:
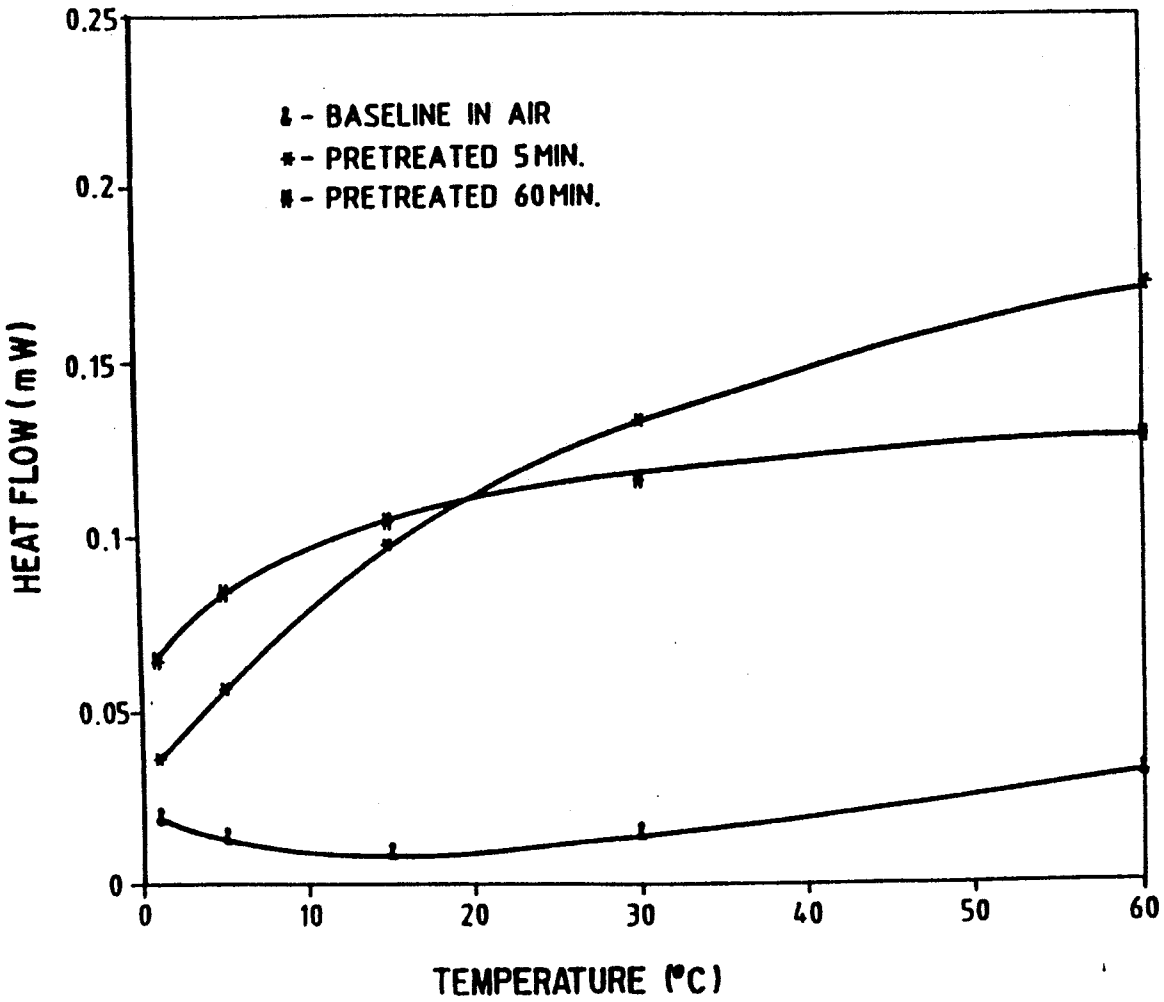

The X-axis in FIGS. 1 through 11C is temperature in degrees centigrade. The Y-axis is heat flow in milliwatts. FIGS. 12, 13 and 14 show load (tension) in grams per denier versus degree of reaction in percent. The degree of reaction is determined using density.

FIG. 1 sample size was 1.136 milligrams. The rate of temperature increase was 10 degrees centigrade per minute wand was in air. The FIG. 2 sample size was 1.110 milligrams and the rate of temperature increase was 10 degrees centigrade per minute in nitrogen. The sample type and rate of temperature increase are set forth below for the data in FIGS. 3–11C.

| FIG. | Sample Size | Type | Rate |
|---|---|---|---|
| 3 | 1.332 mg | AB | 10 |
| 4 | 1.396 mg | CE | 10 |
| 5 | 1.369 mg | AB | 10 |
| 6 | 1.320 mg | CE | 10 |
| 7 | 0.243 mg | AB | 10 |
| 8 | 0.791 mg | CE | 10 |
| 9 | 1.246 mg | DUP | 10 |
| 10 | 8.826 mg | DUP | 10 |
| 11 | 4.624 mg | DUP | 10 |
| 11A | 1.332 mg | DUP | 10 |
| 11B | 1.327 mg | DUP | 10 |
| 11C | 3.178 mg | DUP | 10 |

Figure 2:
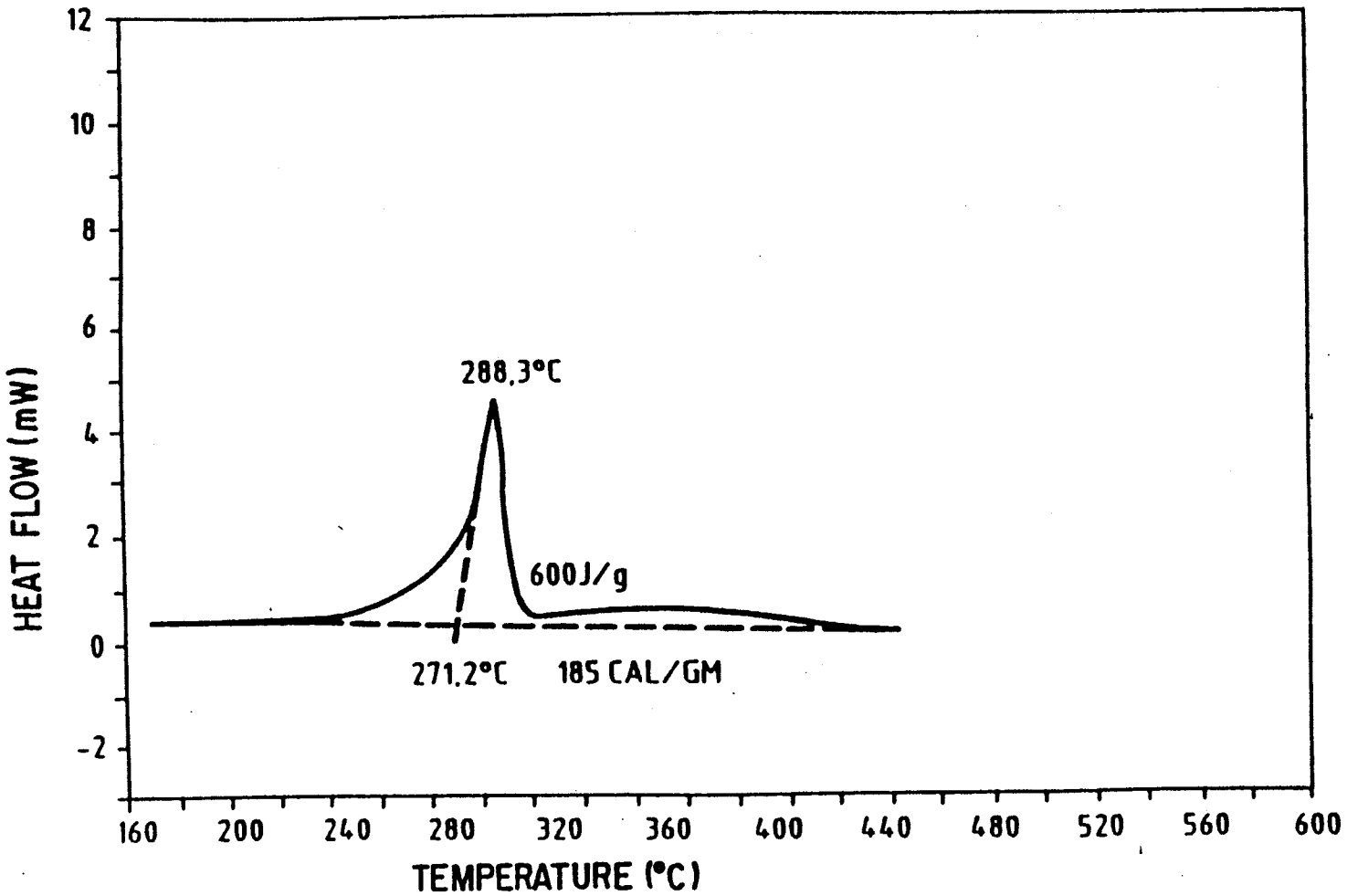
Figure 9:
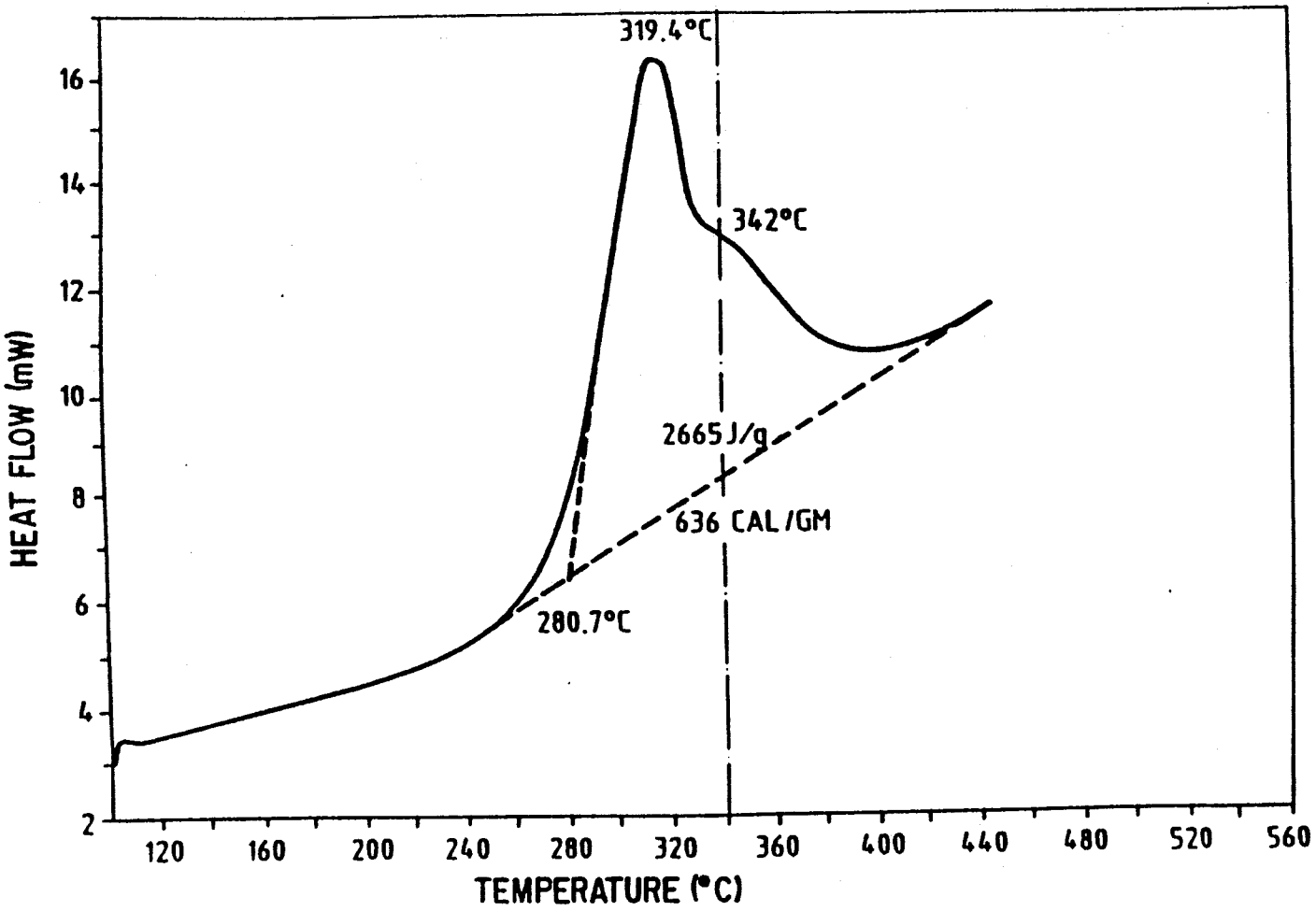
Figure 10:
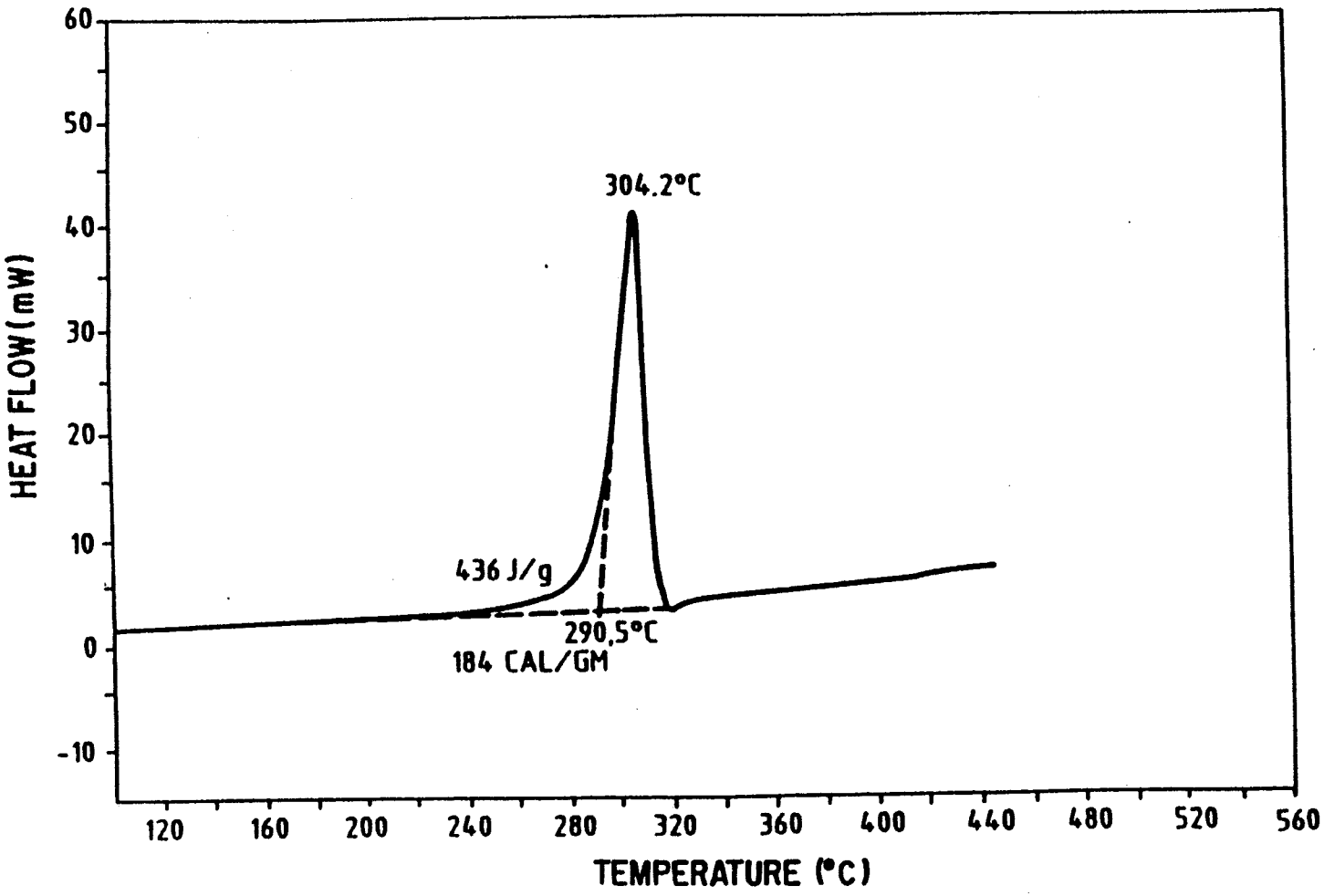

In FIGS. 1 and 2 DSC was respectively in air and nitrogen. DSC of FIGS. 3 and 4 was in nitrogen. DSC was in air for FIGS. 5, 6 (both Purge) and 7 and 8 (second heating). FIG. 9 of the DSC was in air (purge) and DSC was in nitrogen (FIG. 10) and then in air in FIG. 11. FIG. 11A was run in nitrogen; FIG. 11B run in air; and FIG. 11C is rerun in air after initial heating in nitrogen.

EXAMPLES

In the work described below "AB Precursor" and "CE Precursor" are standard carbon fiber precursors made from acrylonitrile and methacrylic acid (2 weight %) in the case of the AB precursor and acrylonitrile, methylacrylate and itaconic acid in case of the CE precursor.

Several experiments were initially run with varying degrees of nitrogen ($N_2$) pretreatment and then analyzed thermally. As seen in FIGS. 1 and 2, the amount of change in heats of decomposition ($H_D$) between precursor heated in air and heated in nitrogen ($N_2$) were different. These differences are typical for acrylic polymers heated in oxygen containing and oxygen free atmospheres with the low $\Delta H_D$ (in $N_2$) due to thermal rearrangement reactions and the large $\Delta H_D$ in air due to thermal rearrangement and oxidation reactions. Table 1 shows the results of two experiments where precursor was first pretreated in $N_2$ at elevated temperatures.

TABLE 1

HEATS OF DECOMPOSITION IN AIR AND $N_2$

| | $\Delta H_D$ cal/gm Air | $N_2$ |
|---|---|---|
| AB Precursor (Baseline) | 1121 | 165 |
| Pretreatment: 235° C., 55 min in $N_2$ | 943 | 116 |
| Pretreatment: 235° C., 116 min in $N_2$ | 844 | 90.8 |

The change in $\Delta H_D$ was 178 cal/g when heated in air after pretreatment in $N_2$ but only 49 cal/g when heated in $N_2$ after the same nitrogen pretreatment for the first sample and 277 cal/g when heated in air after pretreatment and only 74 cal/g when heated in $N_2$ after pretreatment for the second. Since the pretreatment heating was carried out in $N_2$, it might be expected that the change in $H_D$ would be the same in both air and $N_2$. However, from this data at least part of the oxidation reaction is not involved with or linked to the rearrangement reaction. If sample 1 pretreatment (235° C./55 min) had been run in air instead of $N_2$, the residual $H_D$, air would be 740 cal/g. The $N_2$ preheat generated only 49 cal/g, but lowered the $H_D$, air by 178 cal/g, so it appears that 129 cal/g of reaction with oxygen was by-passed by the $N_2$ preheat. The $N_2$ preheat for 116 min at 235° C. generated 74 cal/g and lowered the $H_D$, air by 277 cal/g so it by-passed 203 cal/g of the expected reaction with oxygen. It is evident that the chemical structure of the fiber is different when preheated in $N_2$ prior to air oxidation.

Figure 3:
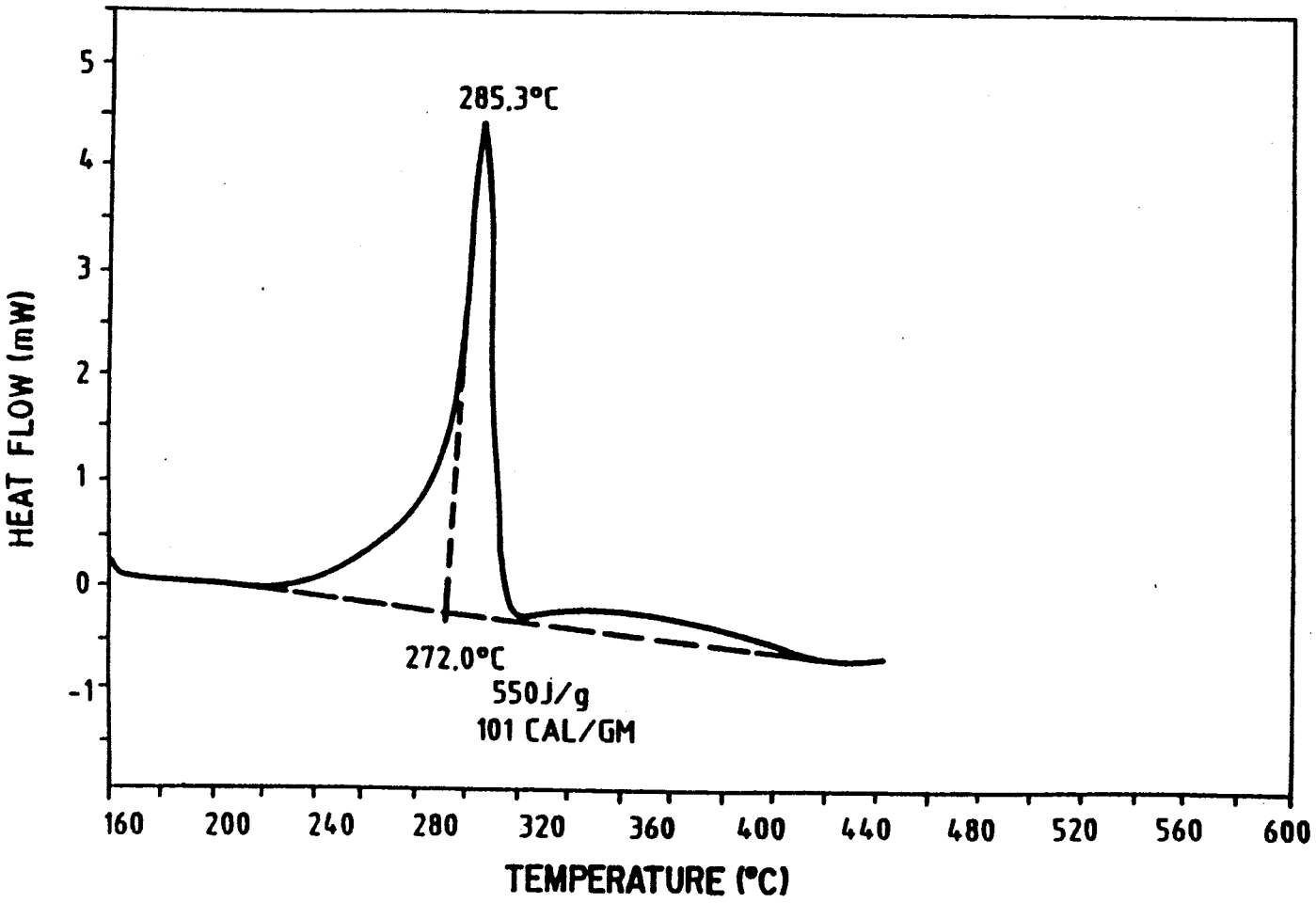
Figure 4:
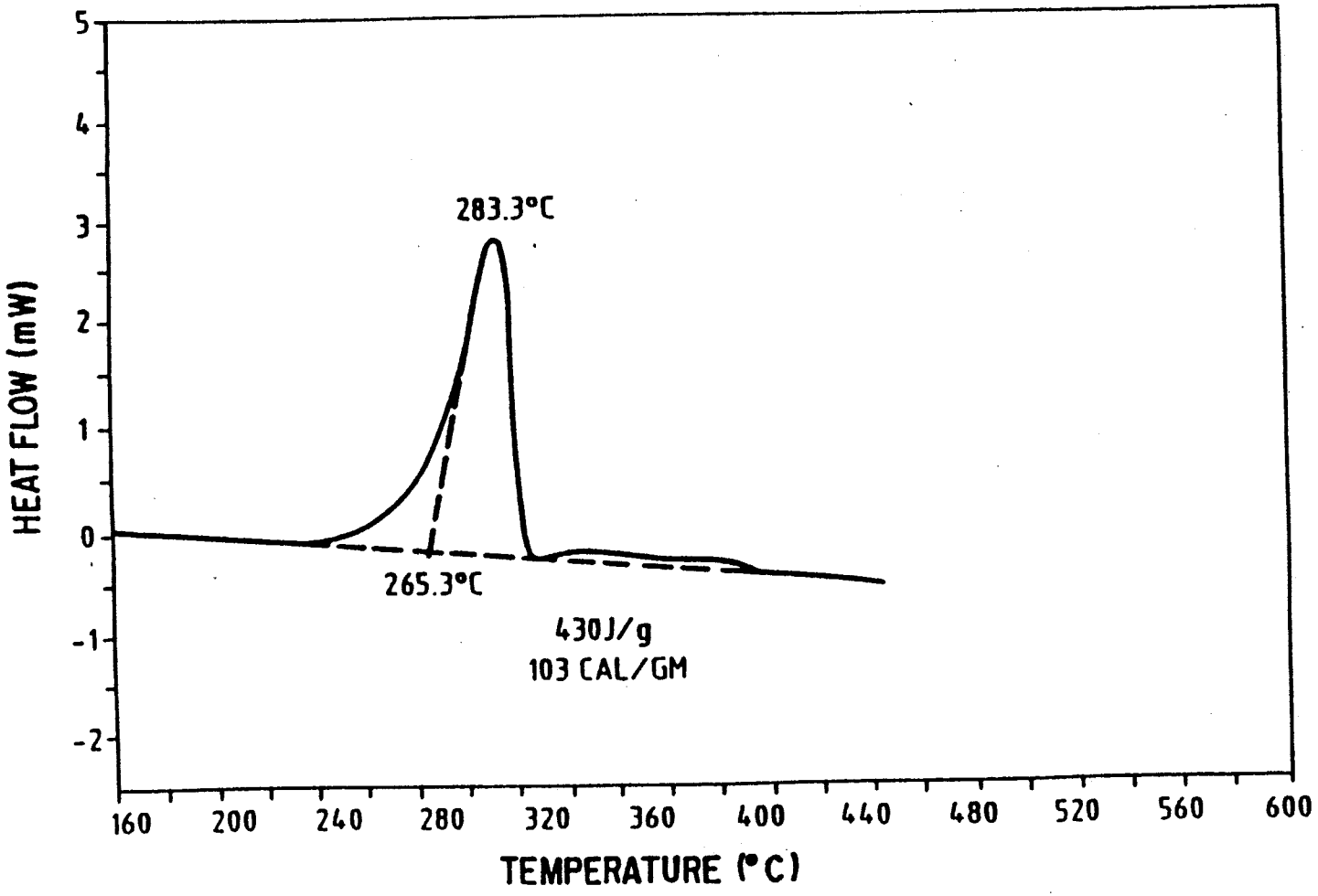
Figure 5:
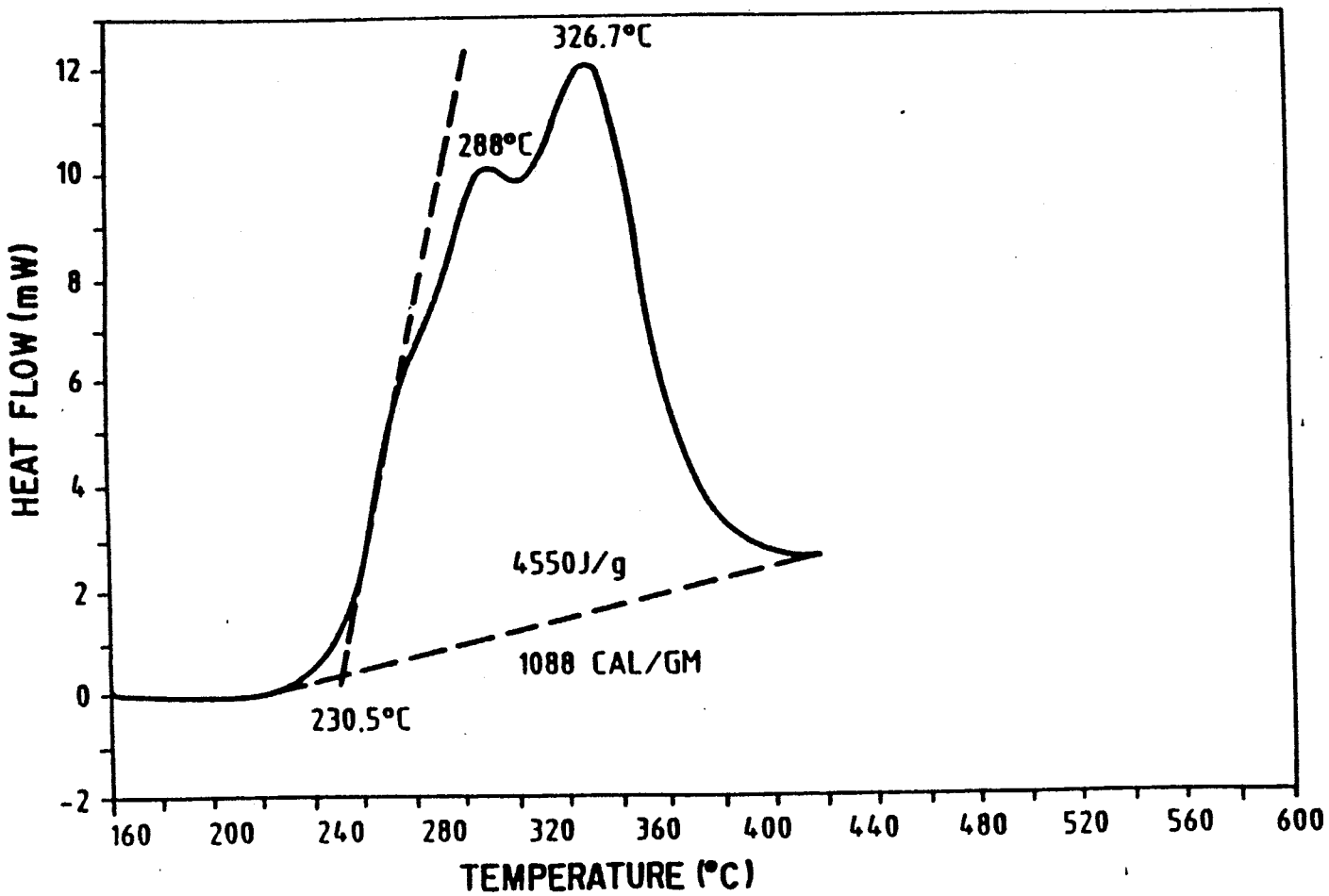
Figure 6:
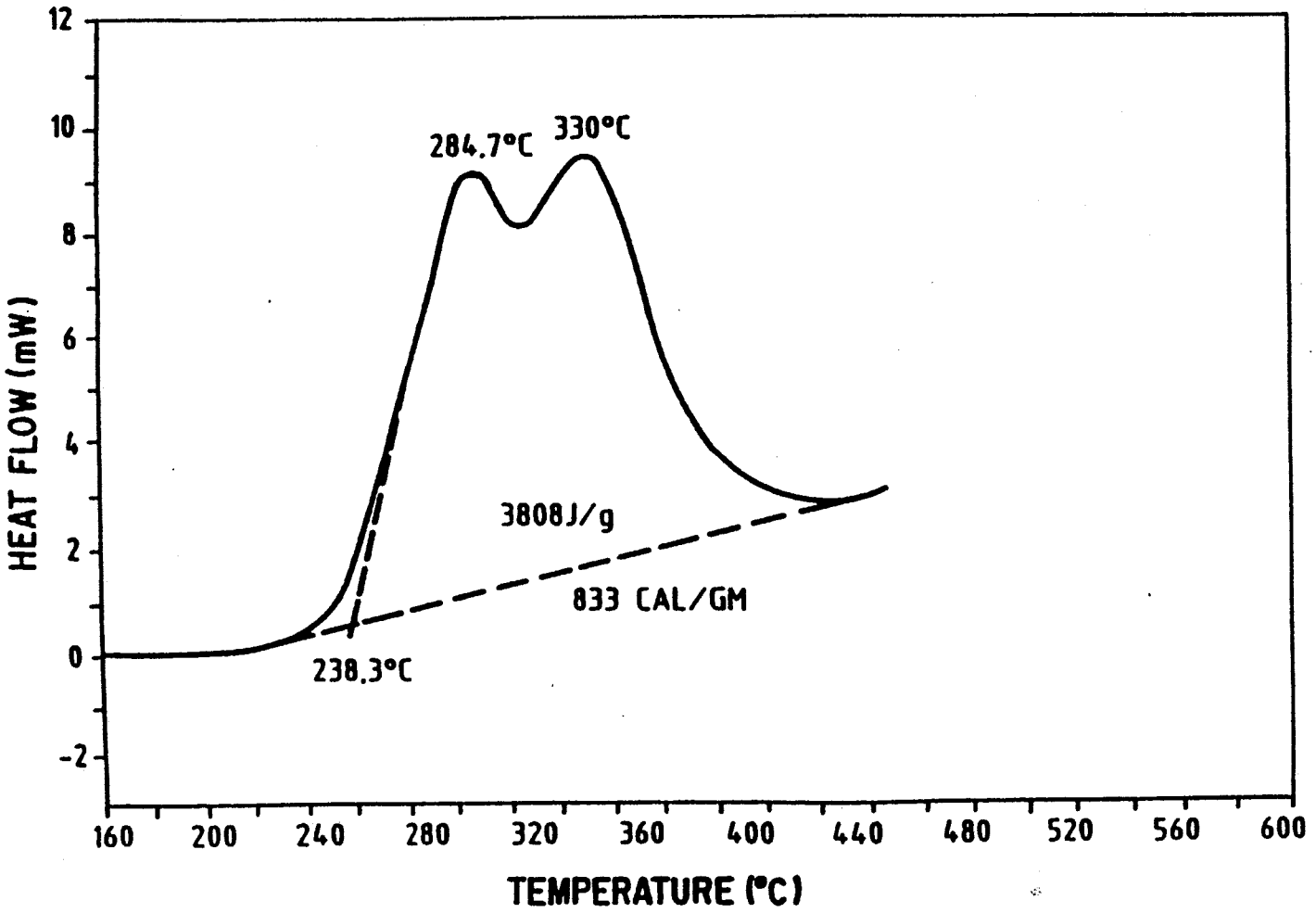
Figure 7:
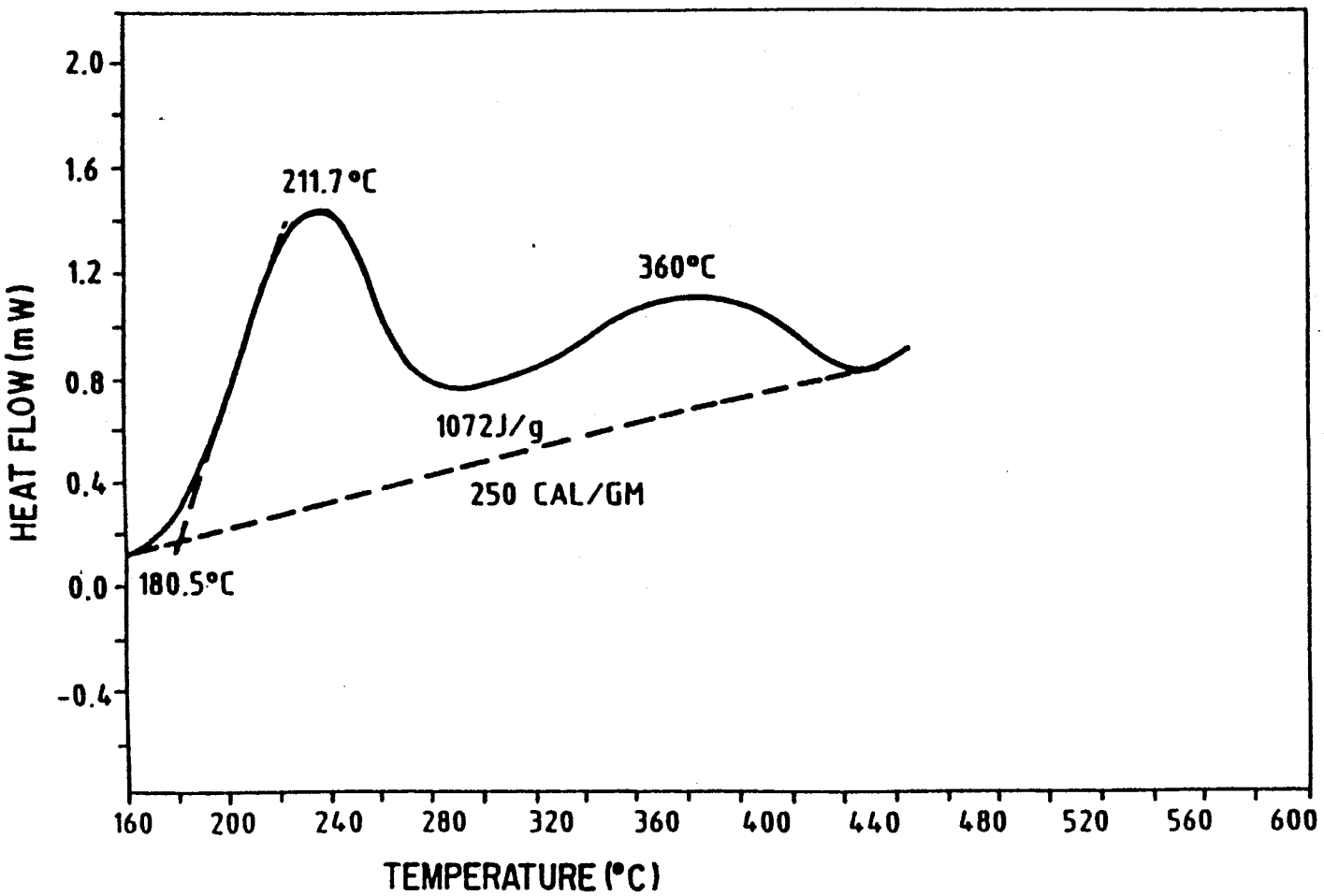
Figure 8:
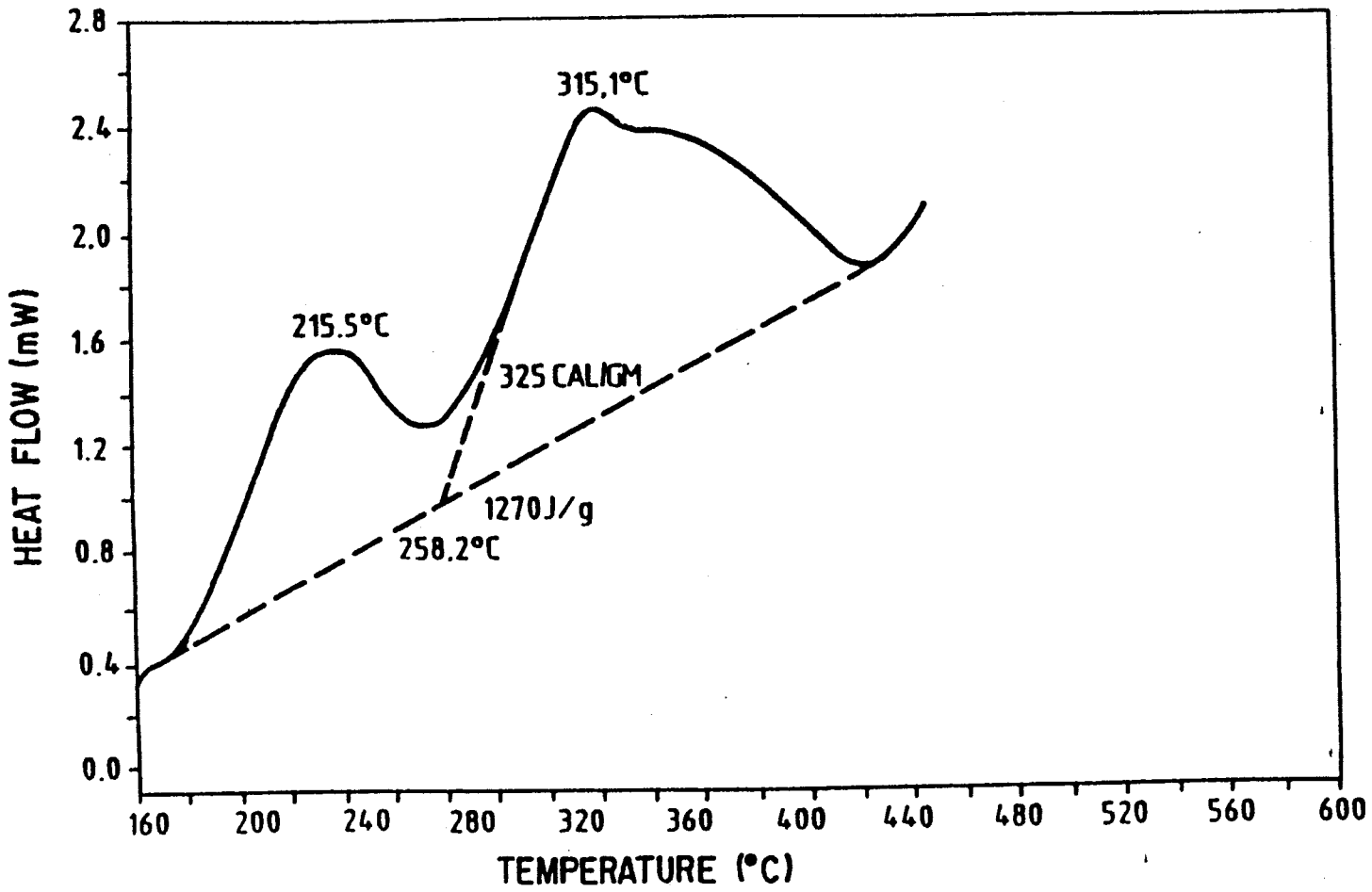

Samples of four different polyacrylonitrile polymers were thermally analyzed in nitrogen and air to better define the mechanisms which were occurring. As part of the analysis, ground precursor fiber was first analyzed in nitrogen, up to about 430° C. The results are shown in FIG. 3 (AB Precursor) and 4 (CE Precursor). The results were not unusual; an exponentially-increasing heat evolution peaking at about 285°-290° C., followed by a rapid heat decrease to give about 100-135 cal/g evolved heat. The resultant thermally-stabilized powder was then reweighed and reanalyzed, this time in air. Normally the air oxidation curve will follow the route shown in FIG. 5 (AB precursor) and FIG. 6 (CE Precursor). Instead, the curve shape was markedly changed. The area under the curve was significantly reduced, from about 1000-1100 cal/g to about 250 cal/g for AB Precursor and 335 cal/g for CE Precursor. In addition, the oxidation-initiation temperature was reduced about 20° C., indicating that the oxidation would be more rapid than non-prestabilized fiber (FIGS. 7 and 8). Additionally, the position of the two major thermal peaks shifted. For the AB Precursor the shift was more dramatic, with the lower peak dropping from a typical 228° C. to 212° C. The position of the higher-temperature peak increased from 326° C. to 360° C. for AB Precursor while it decreased for CE Precursor from 330° C. to 315° C.

These results suggest a major change in the oxidation reactions. There appear to be more oxidatively-active sites after the nitrogen pretreatment as evidenced by the decrease in initiation temperature. There also appears to be less overall oxidation, or possibly less dehydrogenation, as evidenced by the higher temperature which may imply more oxidative stability or may simply mean that the influence of the lower-temperature reactions is dissipated leaving only the higher-temperature part of the response.

The thermal analysis of DuPont T-42 polymer, a commercial grade polyacrylonitrile polymer fiber, in air (FIG. 9) indicates that it would be a less suitable precursor than AB Precursor due to its high initiation temperature and rapid heat evolution rate. If the precursor is first prestabilized in $N_2$ (FIG. 10) and then reheated in air (FIG. 11), the thermal response changes dramatically, similar to what has been seen with the other acrylic polymers. The reaction initiation temperature has decreased substantially, the single peak has split into two very distinct peaks, and the total heat of reaction is only 34 cal/gm.

PAN homopolymer, which is typically avoided at present as a carbon fiber precursor in commercial practice because of its slow reaction rate, high rate of that evolution once it begins to react, and high initiation temperature was also found to undergo dramatic changes in thermal characteristics once it was prestabilized. FIG. 11A shows the typical DSC curve for this polymer in nitrogen with a heat of decomposition of 124 cal/gm, while FIG. 11B shows the thermal curve in air. The heat of reaction in air (1103 cal/gm) is typical of other acrylic polymers, but the homopolymer is characterized by a high initiation temperature (250° C.) and rapid heat evolution rate (steep slope). When the polymer is prestabilized by running the DSC in nitrogen and then rerun in air, the changes are dramatic (FIG. 11C). The initiation temperature drops to 155° C. with the single peak splitting into two distinct peaks, the rate of heat evolution drops significantly as evidenced by a change in initial slope (note change in y-axis range between FIGS. 11B and 11C), and the overall heat of reaction has dropped to 237 cal/gm. Those results indicate the polymer may make a much more suitable carbon fiber precursor from the standpoint of ease of processability, safety, and potentially, economics.

These data also suggest that the fiber will be more easily oxidized after prestabilization. As such, a fiber which has been prestabilized and oxidized for a given time at temperature will have a higher density than a fiber which is only oxidized for the same time at temperature. A set of experiments was run to determine if this is true; the results are shown in Table 2 below.

TABLE 2

DU PONT T-42 PRESTABILIZATION AND OXIDATION DENSITIES

| Conditions | Density (g/cc) |
|---|---|
| 235° C., 2 hr, air | 1.2688 |
| 235° C., 1 hr, $N_2$; then 235° C., 1 hr, air | 1.2904 |
| 235° C., 1 hr, air 235° C., 1 hr, $N_2$ | 1.2101 |

The fiber which has been prestabilized and oxidized does exhibit a higher density than the fiber which has just been oxidized at the same temperature for the same amount of time. This is believed due to the increase in reactivity after prestabilization since prestabilization alone results in a rate of density increase which is less than that due to oxidation in air (Table 2 and FIG. 12). Looking at the density difference between the oxidized and prestabilized/oxidized fibers and assuming kinetics similar to the reaction kinetics of the AB Precursor for comparison purposes, the increase in oxidized fiber density due to prestabilization corresponds to a time savings of 40 minutes at 235° C. That is, in order to reach the same oxidized density as the prestabilized/oxidized fiber, the Precursor fiber would have to be oxidized for 160 minutes at 235° C. instead of stabilized/oxidized for a total of 120 minutes at 235° C.

Another way to monitor the reaction characteristics of an acrylic based precursor is to follow the tension which is generated as the fiber rearranges and oxidizes at elevated temperatures. Tension vs time data were generated for AB and DuPont precursors and prestabilized fibers to further clarify changes in oxidation reaction characteristics which are caused by prestabilization in an inert atmosphere.

FIG. 13 shows load/time data for AB precursor in air at 235° C., $N_2$ at 235° C., and for AB prestabilized for varying amounts of time and then run in air at 235° C. Comparing the samples run in air and $N_2$ (no stabilization), both samples show the characteristic drop in tension initially followed by a tension increase as the fiber begins to react. The tension increase due to the shrinkage of the sample run in $N_2$ is significantly less than in air, the difference presumably being due to the added shrinkage of the oxidation reactions occurring in air.

The prestabilized fibers show a sudden increase in tension when run in air possibly indicating an initial increase in the degree of reactivity. The load build up quickly levels out for the 60 minute prestabilized fiber, followed by 30 minute, and 5 minute which has a final load after 60 minutes, similar to AB Precursor. These lower oxidation loads could be due to a lower overall oxidation reactivity for the prestabilized fibers which would agree with DTA results showing lower than expected residual heats of reaction in air after prestabilization.

The results for the DuPont T-42 type fiber are shown in FIG. 14. This fiber is characteristically slower to react than AB as evidenced by the slow load buildup for the AB Precursor. After prestabilization, the shrinkage characteristics of the fiber are greatly altered. The tension increase with time, while not as great as for AB Precursor, is similar in shape, indicating the fiber may oxidize more readily after prestabilization. As with the prestabilized AB Precursor samples, the T-42 type fibers show a rapid initial increase in tension (the greater the degree of prestabilization, the greater the rate of tension buildup). After 60 minutes, the more highly prestabilized fiber has a lower load buildup than the other prestabilized fiber (similar to AB results) but both samples are significantly higher than the baseline indicating the prestabilization (even after as little as five minutes) results in an increase in oxidation reaction rate, but may reduce the number of sites available for reaction. These results indicate that prestabilization can be used to make certain precursor fibers more reactive while also increasing the safety of the process by reducing the oxidation exotherm.

Another interesting finding from these experiments is that prestabilization changes fiber reactively sufficiently to cause a subsequent reaction in air at room temperature.

A set of AB fibers were stabilized in $N_2$ at 250° C. for times ranging from 5 minutes to 6 hours. In each case, the sample was then divided in half, with half placed in an inert atmosphere and the other half stored in air, both at room temperature. In all cases, the sample in air continued to change color and slowly darken while the sample in $N_2$ remained golden brown. It was found that this reaction could be suspended by placing the partially darkened sample in $N_2$ and then reinitiated by exposing again to air. The fibers exposed to air after prestabilization were able to oxidize at room temperature. If oxidation type reactions were indeed occurring, it would be expected that the residual heat of reaction would decrease with increasing time of exposure to air at room temperature. A series of experiments was performed to determine if this was indeed the case. In one set of experiments, a length of AB Precursor was stabilized in $N_2$ for 2 hours at 250° C.; the fiber was divided in half with half exposed to room-temperature air for 3 hours and the other half exposed to air for 24 hours. The samples were then restored in $N_2$ and submitted for thermal analysis. In all cases, the thermal lab was careful to run the samples as quickly as possible after the $N_2$ seal was broken. In the second experiment, a sample of AB Precursor was stabilized for 16 hours at 250° C. in $N_2$ and then divided with parts exposed for 0 hours, 1 hour, 3 hours, and 24 hours in air. Samples were then restored in $N_2$ and thermally analyzed The results are shown in Table 3 below:

TABLE 3

CHANGE IN $\Delta H_{air}$ OF STABILIZED FIBERS AFTER VARYING AMOUNTS OF EXPOSURE TIME IN AIR

| Stabilization Conditions in $N_2$ | Air Exposure Time at Room Temperature (hr) | $\Delta H_{air}$ |
|---|---|---|
| 2 hours at 250° C. | 3 | 684 |
| 2 hours at 250° C. | 24 | 624 |
| 16 hours at 250° C. | 0 | 678 |
| 16 hours at 250° C. | 1 | 652 |
| 16 hours at 250° C. | 3 | 605 |
| 16 hours at 250° C. | 24 | 548 |

For both sets of these experiments, the heat of reaction decreased with time of exposure in air, indicating a reaction occurring at room temperature which is responsible for the color change we had noted. A stabilized fiber was also run to determine if free radicals are present, which might be initiating the reaction at room temperature in air. The results indicated the presence of some free radical activity, which is as yet unidentified.

I claim:

1. A method of manufacturing carbon fiber from a precursor comprising a polyacrylonitrile polymer in the form of one or more tows each comprising a multitude of filaments which comprises in sequence the steps of: heating said precursor in an atmosphere which is substantially free of oxygen so as to form a thermally stabilized precursor, wherein said thermally stabilized precursor has a residual heat of reaction in differential scanning calorimetry which is at least about ten percent lower than said residual heat of reaction prior to said heating in said atmosphere substantially free of oxygen; oxidizing said thermally stabilized precursor; and carbonizing said thermally stabilized precursor.

2. The method in accordance with claim 1, wherein without this invention there is a plurality of said tows which travel together at a first line speed as a band of closely spaced tows through an oven or ovens maintained at a temperature in a first range for forming said stabilized precursor that is oxidized but wherein in accordance with this invention, said plurality of twos travel together at a second, higher line speed than said first line speed as a band of closely spaced tows through a furnace which is substantially free of oxygen followed by travel at said higher line speed through said oven or ovens.

3. The method in accordance with claim 2, wherein said band travels through an oven or ovens maintained at a temperature below that temperature which would otherwise be optimal in providing a stabilized precursor that is oxidized.

4. The method in accordance with claim 1, wherein said polyacrylonitrile polymer is made from monomers consisting essentially of acrylonitrile and one or more other monomers.

5. The method in accordance with claim 1, wherein said polyacrylonitrile polymer is made from monomers consisting essentially of acrylonitrile.

6. The method in accordance with claim 1, wherein said polyacrylonitrile polymer is made from monomers consisting of acrylonitrile.

7. The method in accordance with claim 1, wherein said atmosphere which is substantially free of oxygen comprises nitrogen.

8. The method in accordance with claim 1, wherein said precursor is heated at a temperature at least about 230° C.

9. The method in accordance with claim 1, wherein said stabilized precursor has a length longer prior to oxidation than said precursor has prior to said heating in said atmosphere substantially free of oxygen.

10. The method in accordance with claim 1, wherein said atmosphere which is substantially free of oxygen comprises a vacuum.

11. The method in accordance with claim 8, wherein precursor is heated at a temperature of up to 500° C.

12. The method in accordance with claim 1, wherein said thermally stabilized precursor has a residual heat of reaction in differential scanning calorimetry which is at least about 20% lower than said residual heat of reaction prior to said heating in said atmosphere substantially free of oxygen.

13. The method in accordance with claim 12, wherein said thermally stabilized precursor has a residual heat of reaction in differential scanning calorimetry which is at least about 35% lower than said residual heat of reaction prior to said heating in said atmosphere substantially free of oxygen.

14. The method in accordance with claim 1, wherein said polyacrylonitrile polymer is made from monomers consisting essentially of acrylonitrile and one or more other monomers, wherein said atmosphere which is substantially free of oxygen comprises nitrogen, and wherein said precursor is heated to a temperature at least about 230° C.

15. The method in accordance with claim 14, wherein said precursor is heated to a temperature of up to 500° C.

16. The method in accordance with claim 14, wherein said thermally stabilized precursor has a residual heat of reaction in differential scanning calorimetry which is at least about 20% lower than said residual heat of reaction prior to said heating in said atmosphere substantially free of oxygen.

17. The method in accordance with claim 16, wherein said thermally stabilized precursor has a residual heat of reaction in differential scanning calorimetry which is at least about 35% lower than said residual heat of reaction prior to said heating in said atmosphere substantially free of oxygen.

* * * * *

UNITED STATES PATENT AND TRADEMARK OFFICE

CERTIFICATE OF CORRECTION

PATENT NO. : 5,256,344
DATED : October 26, 1993
INVENTOR(S) : Warren C. Schimpf

It is certified that error appears in the above-indentified patent and that said Letters Patent is hereby corrected as shown below:

In the Claims, Col. 8, Claim 2, line 63, "twos" should read --tows--.

Signed and Sealed this

Sixteenth Day of May, 1995

Bruce Lehman

*Attest:*

BRUCE LEHMAN

*Attesting Officer*

*Commissioner of Patents and Trademarks*